United States Patent [19]

Stiffler et al.

[11] Patent Number: 4,981,328

[45] Date of Patent: Jan. 1, 1991

[54] ROTATABLE TOOL HAVING A CARBIDE INSERT WITH BUMPS

[75] Inventors: Stephen P. Stiffler, New Enterprise; Ray C. MacIntyre, Alum Bank; Daniel C. Sheirer, Bedford; Wayne H. Beach, Roaring Spring, all of Pa.

[73] Assignee: Kennametal Inc., Latrobe, Pa.

[21] Appl. No.: 396,885

[22] Filed: Aug. 22, 1989

[51] Int. Cl.[5] ..... E21B 10/46; E21C 35/18

[52] U.S. Cl. ..... 299/79; 175/410; 175/411; 299/86

[58] Field of Search ..... 299/79.86, 91; 175/409, 175/410, 411, 374, 375; 76/101 E, 108 R, 108 A, DIG. 5, 11; 407/118; 172/745, 713; 51/309

[56] References Cited

U.S. PATENT DOCUMENTS

| | | | |
|---|---|---|---|
| 3,957,307 | 5/1976 | Varda | 299/86 |
| 4,201,421 | 5/1980 | Den Besten et al. | 299/86 |
| 4,216,832 | 8/1980 | Stephenson et al. | 299/91 X |
| 4,497,520 | 2/1985 | Ojanen | 299/86 |
| 4,627,665 | 12/1986 | Ewing et al. | 299/79 |
| 4,725,099 | 2/1988 | Penkunas et al. | 299/86 |
| 4,940,288 | 7/1990 | Stiffler et al. | 299/79 |

FOREIGN PATENT DOCUMENTS

| | | | |
|---|---|---|---|
| 0122893 | 10/1984 | European Pat. Off. . | |
| 2846744 | 4/1980 | Fed. Rep. of Germany | 299/86 |
| 3510072 | 9/1986 | Fed. Rep. of Germany | 299/91 |
| 132160 | 3/1960 | U.S.S.R. | 299/79 |

OTHER PUBLICATIONS

Drawing No. 5172-PD., 4-1979.
Drawing No. SK-41279-2, 1-1981.

*Primary Examiner*—Ramon S. Britts
*Assistant Examiner*—David Bagnell
*Attorney, Agent, or Firm*—John J. Prizzi

[57] ABSTRACT

A rotatable cutting tool having a tool body with a socket contained in the forward end thereof wherein a hard insert is affixed to the tool body within the socket. The hard insert comprises an integral tip portion and an integral cylindrical flange portion joined to the tip portion by integral mediate portion. An integral boss projects from the bottom surface of the flange portion wherein the boss is of a generally frusto-conical shape which corresponds to the generally frusto-conical volume defined by the socket. A plurality of bumps projects from the bottom surface of the flange portion and the frusto-conical surface of the boss to provide for a braze joint of uniform thickness between the hard insert and the tool body.

29 Claims, 3 Drawing Sheets

ROTATABLE TOOL HAVING A CARBIDE INSERT WITH BUMPS

BACKGROUND OF THE INVENTION

The invention is directed to a rotatable cutting tool having a hard carbide insert affixed to a socket in an elongate body, and more specifically, to such a rotatable cutting tool designed so as to provide for a greater ease of manufacture, a more satisfactory braze joint between the hard carbide insert and elongate body, improved performance, and an indicator whereby the operator will know when the hard insert is worn and ready to be changed.

In the past, rotatable cutting tools have been put to a number of uses including use as a road planing tool in a road planing machine. Typically, a road planing machine includes a rotatable drum having a plurality of blocks affixed thereto. Each block contains a central bore therein. Earlier rotatable cutting tools used in road planing applications typically comprise an elongate steel body with a hard cemented carbide tip brazed into a socket contained in the forward end of the steel body. The steel body includes a reduced diameter portion adjacent the rearward end thereof. A retainer is positioned adjacent the reduced diameter portion of the steel body and functions to rotatably retain the rotatable cutting tool within the bore of the mounting block during operation. In operation, the drum rotates whereby the rotatable cutting tools impact the road surface so as to cut and break up the road surface.

Heretofore, a number of designs of rotatable cutting tools have been used or described in patents and/or printed publications.

U.S. Pat. No. 4,216,832 to Stephenson et al. discloses a rotary earthworking tool wherein FIG. 10 illustrates a hard cemented carbide insert. This insert includes a conical tip section, a frusto-conically shaped section axially rearward of the conical section, a cylindrical flange section axially rearward of the frusto-conically shaped section, and a valve seat contiguous with and positioned axially rearwardly of the cylindrical flange section. The valve seat consists of a second frusto-conically shaped section contiguous with and axially rearward of the cylindrical flange section and a cylindrically shaped boss contiguous with and axially rearward of the second frusto-conically shaped section. The assignee of the present patent application, Kennametal Inc. of Latrobe, Pa., has manufactured and sold rotatable cutting tools under the designation of C-3LR which utilize a cemented carbide insert having substantially the same configuration as the cemented carbide insert illustrated in FIG. 10 of U.S. Pat. No. 4,216,832 to Stephenson et al.

Kennametal Inc. has also manufactured various styles of rotatable cutting bits which utilize a cemented carbide insert wherein the insert includes the valve seat structure.

This style of a valve seat is generally shown in European Patent Application No. 84850079.9 published Oct. 24, 1984. It should be appreciated that cemented carbide inserts which utilize the valve seat structure require a meaningful amount of carbide to be positioned within the socket of the elongate steel body. The cemented carbide insert is a relatively expensive part of the overall rotatable cutting tool so that any reduction in the weight of the cemented insert without losing any performance properties would be desirable.

Even if the amount of carbide used in the cemented carbide insert remained the same, it would be highly desirable to provide an improved rotatable cutting tool utilizing a cemented carbide insert wherein more of the cemented carbide would be used to impact the substrate than which has been utilized in the past.

U.S. Pat. No. 4,497,520 to Ojanen shows a rotatable cutting bit which utilizes a so-called flat bottom hard carbide insert wherein the base section of this tip is positioned within a shallow flat bottom cylindrical bore contained in the front end of the elongate steel body.

Applicants are also aware of a carbide tip similar to the shape as set forth in U.S. Pat. No. 4,497,520, except that it contains a plurality of protrusions on the axially rearwardly facing flat bottom surface of the cemented carbide insert. The apparent purpose of these bumps is to maintain the uniformity of the braze thickness between the flat bottom of the insert and the flat bottom of the socket.

Applicants are also aware of the use of protrusions or bumps contained on the frusto-conically shaped surface of the valve seat of a cemented carbide insert. Again, the apparent purpose of these bumps is to maintain the uniformity of the braze thickness between the frusto-conically shaped surface of the valve seat and its corresponding surface of the socket.

SUMMARY OF THE INVENTION

It is an object of the invention to provide an improved rotatable cutting tool having a cemented carbide insert affixed to a socket in the forward end of the tool body.

It is another object of the invention to provide an improved rotatable cutting tool having a cemented carbide insert and its corresponding socket contained in the forward end of the tool body designed so as to provide for greater ease of manufacturing.

It is another object of the invention to provide an improved rotatable cutting tool having a cemented carbide insert and its corresponding socket contained in the forward end of the tool body designed so as to provide for greater uniformity of braze joint thickness.

It is another object of the invention to provide an improved rotatable cutting tool wherein the cemented carbide insert and its corresponding socket contained in the forward end of the tool body are designed so as to provide for an improved performance characteristics.

Finally, it is an object of the invention to provide an improved rotatable cutting tool wherein the cemented carbide insert thereof is designed so as to provide an indicator whereby the operator will know when the tip is worn past its useful life and is ready to be changed.

The invention in one form thereof is a rotatable cutting tool comprising a tool body having opposite forward and rearward ends. The forward end has a socket contained therein wherein the socket has a generally flat bottom surface and a generally frusto-conically shaped annular side surface whereby the socket defines a volume of a generally frusto-conical shape.

A hard insert is affixed to the tool body at the forward end thereof. The hard insert comprises an integral tip portion and an integral cylindrical flange portion which is joined to the tip portion by an integral mediate portion. The integral mediate portion is contiguous at the axially forward end thereof with the tip portion and at the axially rearward end thereof with the flange portion. The flange portion has a bottom surface which faces axially rearwardly.

The hard insert further includes an integral boss projecting from the bottom surface of the flange portion wherein said boss has a generally flat bottom surface and a generally frusto-conically shaped annular side surface wherein the shape of the boss generally corresponds to the shape of the socket.

The hard insert further includes a first means, projecting from the bottom surface from the flange portion, for providing a uniform spacing of the bottom surface from the surface of the one end of the tool body. The hard insert further includes a second means, projecting from the frusto-conical surface of the boss, for providing a uniform spacing of the frusto-conical portion of the boss from the frusto-conical surface of the socket.

The invention in another form thereof is a rotatable cutting tool comprising a tool body having opposite forward and rearward ends wherein the forward end has a socket contained therein. The socket has a generally flat bottom surface and a generally frusto-conically shaped annular side surface whereby the socket defines a volume of a generally frusto-conical shape.

A hard insert is affixed to the tool body at the forward end thereof. The hard insert comprises an integral tip portion, an integral mediate cylindrical portion contiguous with and positioned axially rearwardly of the tip portion, an integral mediate concave portion contiguous with and positioned axially rearwardly of the mediate cylindrical portion, and an integral mediate frusto-conical portion contiguous with and positioned axially rearwardly of the mediate concave portion. The mediate frusto-conical portion is disposed at an angle approximately equal to the wear angle of the hard insert. An integral cylindrical flange portion is contiguous with and positioned axially rearwardly of the mediate frusto-conical portion. The flange portion has a bottom surface facing axially rearwardly. An integral boss projects from the bottom surface of the flange portion. The boss has a generally flat bottom surface and a generally frusto-conically shaped annular side surface wherein the shape of the boss generally corresponds to the shape of the socket.

The hard insert further includes means, projecting from the bottom surface of the flange portion and the frusto-conical surface of the boss, for providing a uniform spacing of the bottom surface and the boss from the surface of the one end of the tool body and the socket.

The invention in yet another form thereof is a hard insert for use in a rotatable cutting tool wherein the insert is affixed in a socket contained in the forward end of the tool. The hard insert comprises an integral tip portion, an integral cylindrical flange portion joined to the tip portion by an integral mediate portion which is contiguous at the axially forward end thereof with the tip portion and at the axially rearward end thereof with the flange portion. The flange portion has a bottom surface facing axially rearwardly.

An integral boss projects from the bottom surface of the flange portion. The boss has a generally flat bottom surface and a generally frusto-conically shaped annular side surface wherein the shape of the boss generally corresponds to the shape of the socket. A first means, projecting from the bottom surface of the flange portion, for providing a uniform spacing of the bottom surface from the surface of the forward end of the tool body. A second means, projecting from the frusto-conical surface of the boss, for providing a uniform spacing of the frusto-conical portion of the boss from the frusto-conical surface of the socket.

In yet another form thereof the invention is a hard insert for use in a rotatable cutting tool wherein the insert is affixed in a socket contained in the forward end of the tool. The hard insert comprises an integral tip section having a maximum first diameter, an integral cylindrical flange portion joined to the tip portion by an integral mediate portion which is contiguous at the axially forward end thereof with the tip portion and at the axially rearward end thereof with the flange portion. The axially forward end of the integral mediate portion being of a second diameter. The maximum first diameter is less than the second diameter. The flange portion has a bottom surface facing axially rearwardly. An integral boss projects from the bottom surface of the flange portion wherein the boss has a generally flat bottom surface and a generally frusto-conically shaped annular side surface wherein the shape of the boss generally corresponds to the shape of the socket. A first means, projecting from the bottom surface of the flange portion, for providing a uniform spacing of the bottom surface from the surface of the forward end of the tool body. A second means, projecting from the frusto-conical surface of the boss, from the frusto-conical surface of the socket.

In still another form the invention comprises a rotatable cutting tool which comprises a tool body having opposite forward and rearward ends wherein the forward end has a socket contained therein. The socket has a generally flat bottom surface and a generally frusto-conically shaped annular side surface whereby the socket defines a volume of a generally frusto-conical shape. A hard insert is affixed to the tool body at the forward end thereof. The hard insert comprises an integral tip portion having a maximum first diameter. An integral concave portion contiguous with and positioned axially rearwardly of the tip portion wherein the concave portion has a minimum second diameter. The maximum first diameter is less than the minimum second diameter. An integral cylindrical flange portion is contiguous with and positioned axially rearwardly of the mediate concave portion. The flange portion has a bottom surface facing axially rearwardly. An integral boss projects from the bottom surface of the flange portion wherein the boss has a generally flat bottom surface and a generally frusto-conically shaped annular side surface with the shape of the boss generally corresponding to the shape of the socket. Means, projecting from the bottom surface of the flange portion and the frusto-conical surface of the boss, for providing a uniform spacing of the bottom surface and the boss from the surface of the one end of the tool body and the socket.

These and other aspects of the present invention will become more apparent upon review of the drawings, which are briefly described below in conjunction with the detailed description of specific embodiments of the invention.

DETAILED DESCRIPTION OF THE SPECIFIC EMBODIMENTS

Figure 1:
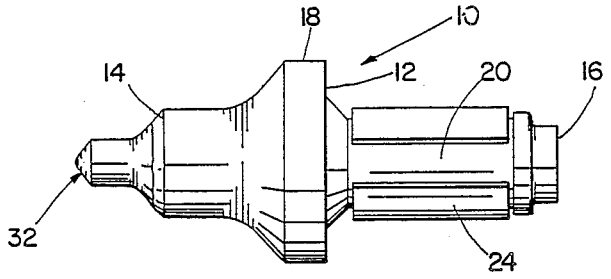
FIG. 1 is a side view of one specific embodiment of the rotatable cutting tool of the invention.

Referring to the drawings, FIG. 1 illustrates a specific embodiment of a rotatable cutting tool, generally designated as 10, of the invention. Rotatable cutting bit 10 includes an elongate steel body 12 having a forward end 14 and a rearward end 16. Elongate steel body 12 includes an enlarged diameter portion 18 midway between the forward end 14 and rearward end 16, and a reduced diameter portion 20 adjacent rearward end 16. A split ring cylindrical retainer 24 is loosely positioned and contained within the reduced diameter portion 20 of steel body 12.

Steel body 12 further contains a socket 26 in the forward end 14 thereof. Socket 26 includes a generally circular bottom surface 28 and a generally frusto-conical annular surface 30 wherein the socket 26 defines a volume of a generally frusto-conical shape. The depth E of socket 26 is equal to about 0.079 inches.

Rotatable cutting bit 10 further includes a cemented carbide insert generally designated as 32. Cemented carbide insert 32 is affixed to the forward end 14 of steel body 12 as will become more apparent hereinafter. The overall axial length of cemented carbide insert 32 is about 0.720 inches.

Cemented carbide insert 32 includes a conical tip portion 34 which has an angle of taper of $A_1$. Angle $A_1$ of this specific embodiment is equal to approximately 45° so that the included angle of taper of conical tip portion 34 is about 90°. The axially forwardmost point of conical tip portion 34 is radiused at a radius of $R_2$, which in this specific embodiment is about 0.125 inches. The maximum diameter K of conical tip portion 34 is about 0.341 inches. The axial length B of conical tip portion 34 is about 0.119 inches.

Cemented carbide insert 32 further includes an integral mediate cylindrical tip portion 36 which is contiguous at its axially forward end with conical tip portion 34. Mediate cylindrical tip portion 36 is contiguous at its axially rearward end with an integral mediate concave portion 38. Mediate concave portion 38 presents a continuous concave surface with a radius of curvature $R_1$ equal to about 0.187 inches. Mediate concave portion 38 is contiguous at its axially rearward end with an integral mediate frusto-conical portion 40 having an angle of taper $A_2$ equal to about 60°. As discussed hereinafter, this angle is approximately equal to the wear angle on the cemented carbide insert for this type of tool. In this specific embodiment, the included angle of taper of the mediate frusto-conical portion 40 is about 120°. However, it is contemplated that this included angle may range between about 110° and about 130°.

These mediate portions of the cemented carbide insert 32; namely, the mediate cylindrical tip portion 36, the mediate concave portion 38 and the mediate frusto-conical portion 40, together comprise what can be considered to be a mediate portion which joins together the conical tip portion 34 to an integral cylindrical portion 42. The overall axial length C of this mediate portion is about 0.452 inches.

Integral cylindrical portion 42 further includes a bottom surface 44 which faces axially rearwardly. Bottom surface 44 is of a generally circular configuration. The diameter H of cylindrical portion 42 is about 0.680 inches. The axial length D of cylindrical portion 42 is about 0.07 inches.

A boss 50 extends a distance of about 0.079 inches from bottom surface 44. Boss 50 includes an annular frusto-conically shaped side surface 52 which terminates in a generally flat bottom surface 54. The maximum diameter I of the boss 50 is about 0.509 inches. The diameter J of the flat bottom surface 54 of boss 50 is about 0.350 inches. In this specific embodiment, the angle of taper $A_3$ of the frusto-conical surface 52 is about 45°. However, it is contemplated that it may range between about 42° to about 48°. The general configuration of the boss 50 corresponds to the configuration of socket 26.

Figure 3:
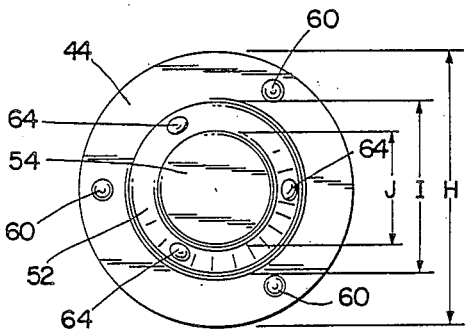
FIG. 3 is a bottom view of the cemented carbide insert of FIGS. 1 and 2.

A trio of bumps 60 project a distance F, equal to between about 0.005 and about 0.008 inches, from the bottom surface 44 and are generally equi-spaced approximately 120° apart. A second plurality of bumps 64 project a distance between about 0.005 and about 0.008 inches from the frusto-conical side surface 52 of boss 50 and are generally equi-spaced apart approximately 120 degrees. The relative orientation of bumps 60 and bumps 64 is such that one set is offset about 60° with respect to the other set. In other words, each bump 60 is offset about 60° from its adjacent bump 64 as illustrated in FIG. 3.

Figure 2:
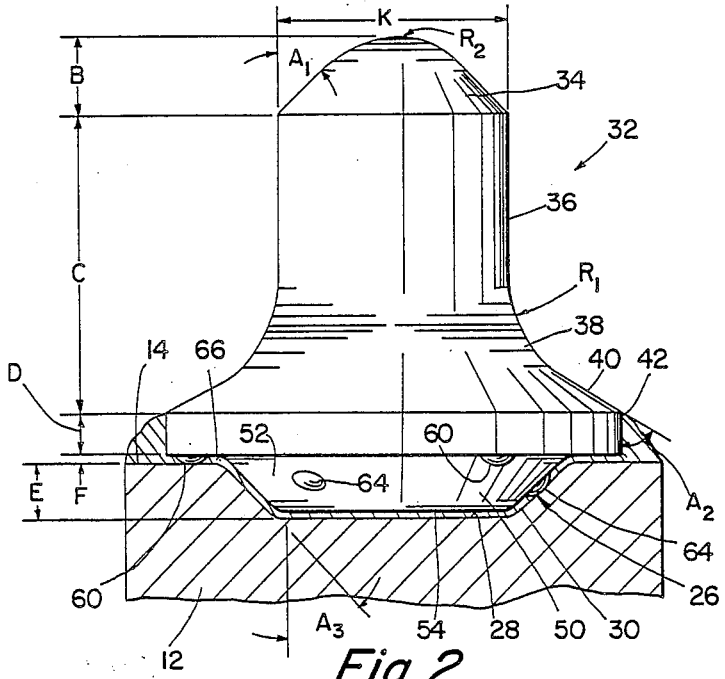
FIG. 2 is a side view of the cemented carbide insert attached to the forward end of the elongate steel body of FIG. 1 with a portion of the steel body cut away to expose the braze joint between the cemented carbide insert and the steel body.

Cemented carbide insert 32 is affixed to steel body 12 by brazing whereby a substantial portion of the boss 50 is contained within the volume of the socket 26. It is apparent from FIG. 2 that the thickness of the braze joint 66 between the cemented carbide insert 32 and steel body 12 is maintained at uniform thickness by use of bumps 60 and bumps 64.

Bumps 60 maintain the uniform spacing between the bottom surface 44 of cemented carbide insert 32 and the forward end of the steel body 12. The thickness of the braze joint 66 between bottom surface 44 and cemented carbide insert 32 is approximately equal to the height of the bumps 60. However, this may vary slightly depending upon whether a thin layer of braze alloy is sandwiched between the bumps 60 and forward end 14 of the steel body 12.

Bumps 64 maintain the uniform spacing between the frusto-conical surface 52 of the cemented carbide insert 32 and the frusto-conical surface 30 of the socket 26. The thickness of the braze joint between frusto-conical surface 52 and frusto-conical surface 30 is approximately equal to the height of the bumps 64. However, this may vary slightly depending on whether a thin layer of braze alloy is sandwiched between the bumps 64 and the frusto-conical surface of the socket 26.

Both sets of bumps 60 and 64 cooperate to maintain the uniform spacing between the flat surface 28 of the recess 26 and the flat surface 54 of the boss 50. As can be appreciated, bumps 60 and 64 maintain the uniform thickness of the braze joint.

Figure 4:
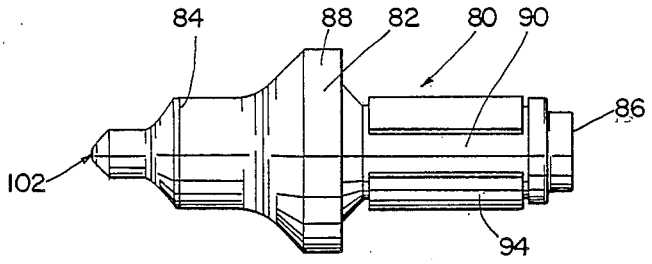
FIG. 4 is a side view of another specific embodiment of the rotatable cutting tool of the invention.

FIG. 4 illustrates another specific embodiment of a rotatable cutting tool, generally designated as 80, of the invention. Rotatable cutting bit 80 includes an elongate steel body 82 having a forward end 84 and a rearward end 86. Elongate steel body 82 includes an enlarged diameter portion 88 midway between the forward end 84 and rearward end 86 and a reduced diameter portion 90 adjacent rearward end 86. A split ring cylindrical retainer 94 is loosely positioned and contained within the reduced diameter portion 90 of steel body 82.

Steel body 82 further contains a socket 96 in the forward end 84 thereof. Socket 96 includes a generally circular bottom surface 98 and a generally frusto-conical annular surface 100 wherein the socket 96 defines a volume of a generally frusto-conical shape. The depth P of socket 96 is equal to about 0.079 inches.

Rotatable cutting bit 80 further includes a cemented carbide insert designated as 102. Cemented carbide insert 102 is affixed to the forward end of steel body 82 as will become more apparent hereinafter. The overall axial length of cemented carbide insert 102 is about 0.720 inches.

Cemented carbide insert 102 includes a conical tip portion 104 which has an angle of taper $A_4$ equal to about 45°. The included angle of taper of the conical tip portion 104 is about 90°. The axially forwardmost point of conical tip portion 104 is radiused at a radius of $R_4$ which in this specific embodiment is approximately 0.125 inches. The maximum diameter V of conical tip portion 104 is about 0.341 inches. The axial length M of conical tip portion 104 is about 0.119 inches.

Cemented carbide insert 102 further includes an integral mediate cylindrical tip portion 106 which is contiguous at its axially forward end with conical tip portion 104. Cylindrical tip portion 106 is also contiguous at its axially rearward end with an integral mediate concave portion 108. Mediate concave portion 108 presents a continuous concave surface with a radius of curvature $R_3$ equal to about 0.187 inches. Mediate concave portion 108 is contiguous at its axially rearward end with an integral mediate frusto-conical portion 110 having an angle of taper $A_5$ equal to about 60°. As discussed hereinafter this angle is approximately equal to the wear angle on the cemented carbide insert for this type of tool. The included angle of taper of the mediate frusto-conical portion 110 is about 120°. However, it is contemplated that this included angle may range between about 110° and about 130°.

These mediate portions of the cemented carbide insert 102; namely, the cylindrical tip portion 106, the concave portion 108 and frusto-conical portion 110, together comprise what can be considered to be a mediate portion which joins together the conical tip portion 104 to a cylindrical portion 112. The overall axial length N of this mediate portion is about 0.482 inches.

Cylindrical portion 112 further includes a bottom surface 114 which faces axially rearwardly. Bottom surface 114 is of a generally circular configuration. The diameter S of cylindrical portion 112 is about 0.800 inches which is equal to the diameter of the forward end 84 of the steel body 82. The axial length 0 of cylindrical portion 112 is about 0.04 inches.

A boss 120 extends about 0.079 inches from bottom surface 114. Boss 120 includes an annular frusto-conically shaped side surface 122 which terminates in a generally flat bottom surface 124. The maximum diameter T of the boss 120 is about 0.509 inches. The diameter U of the flat bottom 124 of boss 120 is about 0.350 inches. The angle of taper $A_6$ of the frusto-conical surface 122 is about 45°. However, it is contemplated that it may range between about 42° to about 48°. The general configuration of the boss 120 corresponds to the configuration of socket 96.

Figure 6:
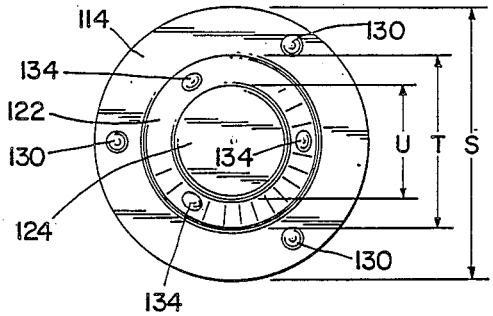
FIG. 6 is a bottom view of the cemented carbide insert of FIGS. 4 and 5.

A trio of bumps 130 project a distance Q of about 0.005 to about 0.008 inches from the bottom surface 114 and are generally equi-spaced approximately 120° apart. A second plurality of bumps 134 project a distance of about 0.005 to about 0.008 inches from the frusto-conical side surface 122 of boss 120 and are generally equi-spaced apart approximately 120°. The relative orientation of bumps 130 and bumps 134 are such that they are offset about 60° with respect to each other. In other words, each bump 130 is offset about 60° from its adjacent bumps 134 as illustrated in FIG. 6.

Figure 5:
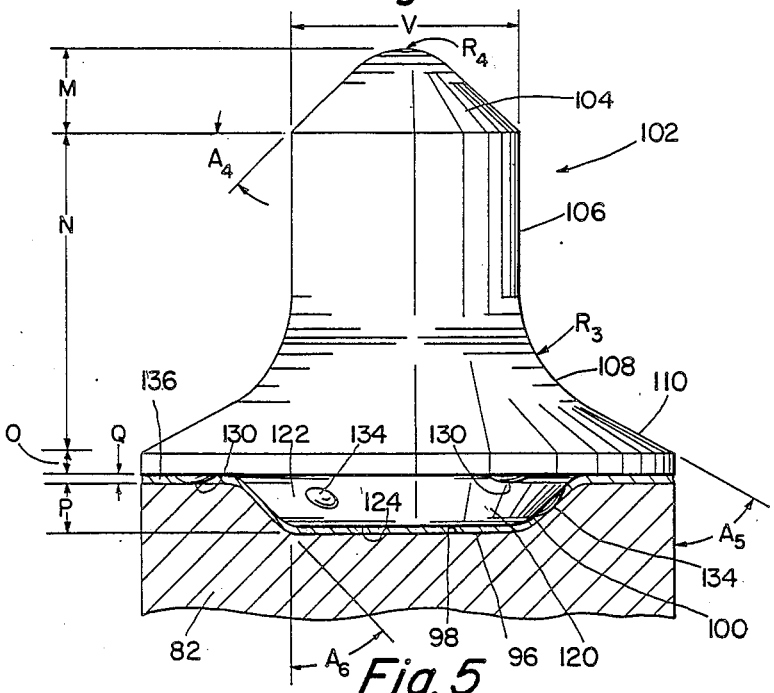
FIG. 5 is a side view of the cemented carbide insert with a portion of the steel body of FIG. 4 cut away to expose the braze joint between the cemented carbide insert and the steel body.

Cemented carbide insert 102 is affixed to steel body 92 by brazing whereby a substantial portion of the boss 120 is contained within the volume of the socket 96. It is apparent from FIG. 5 that the thickness of the braze joint 136 between the cemented carbide insert 102 and steel body 92 is maintained at a uniform thickness by use of bumps 130 and 134.

Bumps 130 maintain the uniform spacing between the bottom surface 114 of the cemented carbide insert 102 and the forward end 84 of the steel body 82. The thickness of the braze joint 136 between bottom surface 114 and cemented carbide insert 102 is approximately equal to the height of the bumps 130. However, this may slightly vary depending upon whether a thin layer of braze alloy is sandwiched between the end of the bump 130 and the surface of the forward end of the steel body.

Bumps 134 maintain the uniform spacing between the frusto-conical surface 122 of the cemented carbide insert 102 and the frusto-conical surface 100 of the socket 96. The thickness of the braze joint 136 between frusto-conical surface 122 and frusto-conical surface 100 is approximately equal to the height of the bumps 134. However, this may vary depending upon whether a thin layer of braze alloy is sandwiched between the end of the bumps 134 and the surface 100 of socket 96.

Both sets of bumps 130 and 134 cooperate to maintain the uniform spacing of between the flat surfaced 98 of the recess 96 and the flat surface 124 of the boss 120. As can be appreciated, bumps 130 and 134 maintain the uniform thickness of the braze joint.

Figure 7:
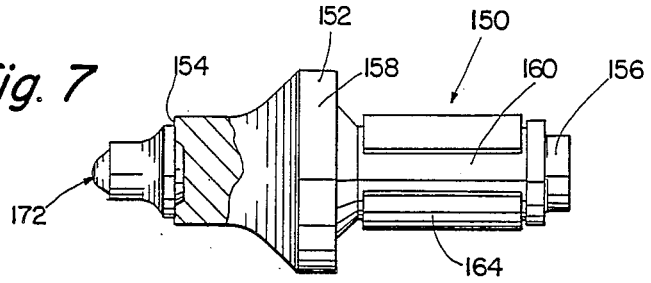
FIG. 7 is a side view of another specific embodiment of the rotatable cutting tool of the invention with a portion of the steel body cut away to expose the braze joint.

Referring to the drawings, FIG. 7 illustrates another specific embodiment of a rotatable cutting tool, generally designated as 150 of the invention. Rotatable cutting bit 150 includes an elongate steel body 152 having a forward end 154 and a rearward end 156. Elongate steel body 152 includes an enlarged diameter portion 158 midway between the forward end 154 and rearward end 156, and a reduced diameter portion 160 adjacent rearward end 156. A split ring cylindrical retainer 164 is loosely positioned and contained within the reduced diameter portion 160 of steel body 152.

Steel body 152 further contains a socket 166 in the forward end 154 thereof. Socket 166 includes a generally circular bottom surface 168 and a generally frusto-conical annular surface 170 wherein the socket 166 defines a volume of a generally frusto-conical shape. The depth AA of socket 166 is equal to about 0.079 inches.

Rotatable cutting bit 150 further includes a cemented carbide insert generally designated as 172. Cemented carbide insert 172 is affixed to the forward end of steel body 152 as will become more apparent hereinafter. The overall axial length of cemented carbide insert 172 is about 0.683 inches.

Cemented carbide insert 172 includes a conical tip portion 174 which has an angle of taper of $A_7$. Angle $A_7$ of this specific embodiment is equal to approximately 45° so that the included angle of taper of conical tip portion 174 is about 90°. The axially forward most point of conical tip portion 174 is radiused at a radius of $R_5$, which in this specific embodiment is about 0.125 inches. The maximum diameter BB of conical tip portion 174 is about 0.341 inches. The axial length CC of conical tip portion 174 is about 0.134 inches.

Figure 8:
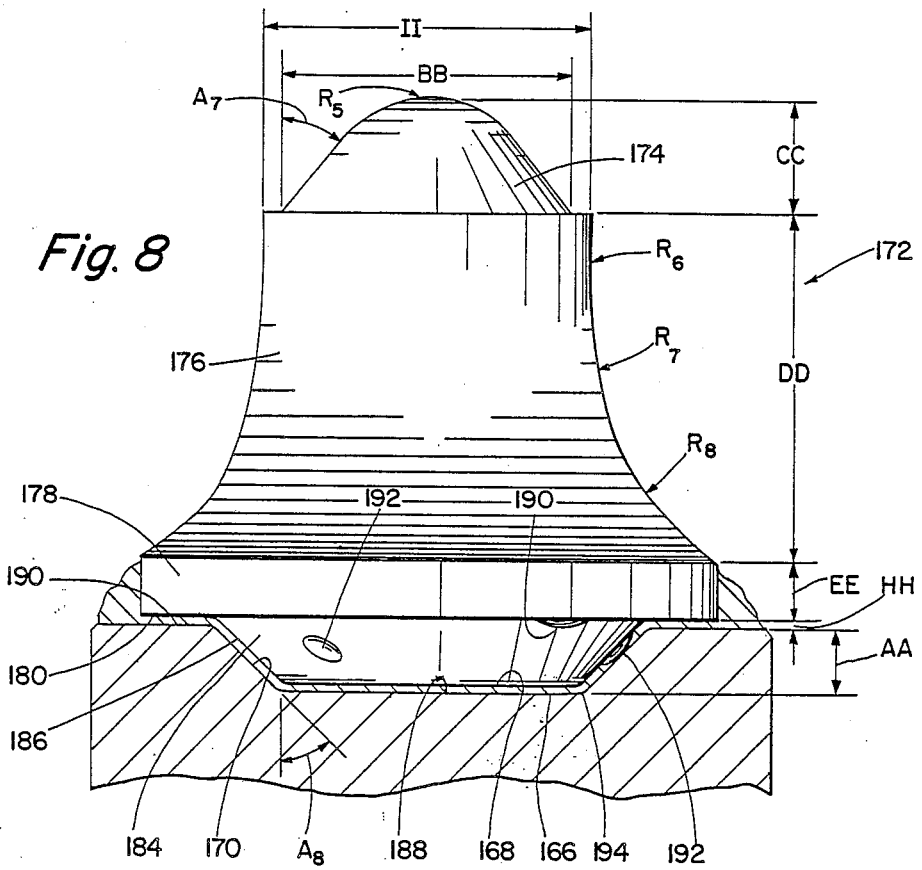
FIG. 8 is a side view of the cemented carbide insert attached to the forward end of the elongate steel body of FIG. 7 with a portion of the steel body cut away to expose the braze joint between the cemented carbide insert and the steel body.

Mediate portion 176 is integral with conical tip portion 174 and joins conical tip portion 174 together with a cylindrical portion 178. Mediate portion 176 has a minimum diameter II equal to about 0.386 inches. As can be appreciated upon viewing FIG. 8, the maximum diameter BB of conical tip portion 174 is less than the minimum diameter II of mediate portion 176. The presence of a step at this location helps to provide a stronger punch of the die set used to press the hard insert.

Mediate portion 176 presents a continuously radially outwardly projecting surface from its junction with conical tip portion 174 and cylindrical portion 178. The surface of mediate portion 176 is defined by a surface having three radii of curvature; namely, radii $R_6$, $R_7$ and $R_8$. In this specific embodiment, radius of curvature $R_6$ is equal to 2.000 inches, radius of curvature $R_7$ is equal to 1.250 inches, and radius of curvature of $R_8$ is equal to 0.269 inches. The overall axial length DD of mediate portion 176 is equal to about 0.463 inches.

Cylindrical portion 178 further includes a bottom surface 180 which faces axially rearwardly. Bottom surface 180 is of a generally circular configuration.

A boss 184 extends a distance of about 0.079 inches from bottom surface 180. Boss 184 includes an annular frusto-conically shaped side surface 186 which terminates in a generally flat bottom surface 188. The maximum diameter FF of boss 184 is about 0.509 inches. The maximum diameter GG of flat bottom surface 188 of boss 184 is about 0.350 inches. The angle of taper $A_8$ of the frusto-conical surface 186 is about 45°. However, it is contemplated that this angle may range over from about 42° to about 48°. The general configuration of the boss 184 corresponds to the configuration of the socket 168.

Figure 9:
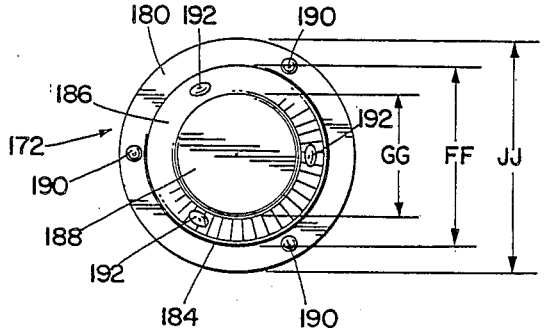
FIG. 9 is a bottom view of the cemented carbide insert of FIGS. 7 and 8.

A trio of bumps 190 project a distance HH equal to about 0.005 inches to about 0.008 inches from the bottom surface 188 and are generally equi-spaced approximately 120° apart. A second plurality of bumps 192 project a distance between about 0.005 inches and about 0.008 inches from the frusto-conical side surface 186 of boss 184 and are general equi-spaced approximately 120°. The relative orientation of bumps 190 and bumps 192 is such that one set is offset about 60° with respect to the other set. In other words, each bump 190 is offset about 60° from its adjacent bump 192 as illustrated in FIG. 9.

Cemented carbide insert 174 is affixed to steel body 152 by brazing whereby substantial portion of the boss 184 is contained within the volume of the socket 166. It is apparent from FIG. 8 that the thickness of the braze joint 194 between the cemented carbide insert 174 and steel body 152 is maintained at uniform thickness by use of bumps 190 and bumps 192.

Bumps 190 maintain the uniform spacing between the bottom surface 188 of cemented carbide insert 172 and the forward end of the steel body 152. The thickness of the braze joint 194 between bottom surface 188 and cemented carbide insert 172 is approximately equal to the height of bumps 190. However, this may very slightly depending upon a thin layer of braze alloy is sandwiched between the bumps 190 and forward end 154 of the steel body 152.

Bumps 192 maintain the uniform spacing between the frusto-conical surface 186 of the cemented carbide insert 172 and the frusto-conical surface 170 of the socket 166. The thickness of the braze joint between frusto-conical surface 186 and frusto-conical surface 170 is approximately equal to the height of the bumps 192. However, this may vary slightly depending upon a thin layer of braze alloy is sandwiched the bumps 192 and frusto-conical surface 170 of the socket 166.

Both sets of bumps 190 and 192 cooperate to maintain the uniform spacing between the flat surface 168 of the socket 166 and the flat surface 188 of the boss 184. As can be appreciated, bumps 190 and 192 maintain the uniform thickness of the braze joint.

In regard to all of the specific embodiments, it is preferred that a high temperature braze material be used in joining the cemented carbide insert to ferrous body so that braze joint strength is maintained over a wide temperature range. The preferred braze material is a HIGH TEMP 080 manufactured and sold by Handy & Harman Inc., 859 Third Avenue, New York, N.Y. 10022. The nominal composition and the physical properties of the Handy & Harman HIGH TEMP 080 braze alloy are set forth below:

| | | | |
|---|---|---|---|
| NOMINAL COMPOSITION: | Copper | 54.85% | 1.0 |
| | Zinc | 25.0 | 2.0 |
| | Nickel | 8.0 | 0.5 |
| | Manganese | 12.0 | 0.5 |
| | Silicon | 0.15 | 0.05 |
| | Total Other Elements | 0.15 | |
| PHYSICAL PROPERTIES: | Color | Light Yellow | |
| | Solidus | 1575° F. (855° C.) | |
| | Liquidus (Flow Point) | 1675° F. (915° C.) | |
| | Specific Gravity | 8.03 | |
| | Density (lbs/cu. in.) | .290 | |
| | Electrical Conductivity (% I.A.C.S.) | 6.0 | |
| | Electrical Resistivity (Microhm-cm.) | 28.6 | |
| | Recommend Brazing Temperature Range | 1675–1875°°F. (915–1025° C.) | |

Acceptable braze joints may be achieved by using braze rings positioned against the bottom surface of the cylindrical portion so as to be adjacent to the location wherein the boss projects from the bottom surface. The circular hole in the braze ring is dimensioned so that the boss projects therethrough. The assembly is then brazed by conventional induction brazing techniques which, in addition to brazing a tip to the steel body, also hardens the steel which may be of any of the standard steels used for rotatable mining and construction tool bodies.

After the brazing and hardening step, the steel is tempered to a hardness of Rockwell C 40–45.

The cemented carbide tip may be composed of any of the standard tungsten carbide-cobalt compositions conventionally used for construction applications. For example, for rotatable asphalt reclamation tools, a standard tungsten carbide grade containing about 5.7 w/o cobalt and having a Rockwell A hardness of about 88.2 may be desirable.

These specific embodiments do not use as much carbide to form the boss as has been previously used to form the valve seat section of earlier hard carbide inserts. Thus, less carbide is positioned within the socket than has been positioned in the socket in earlier hard inserts designed to incorporate a valve seat. A reduction in the amount of carbide contained within the socket without any loss of performance is advantageous. A reduction in the total amount of carbide in the hard insert without a reduction in performance is also desirable. The specific embodiment depicted in FIGS. 1–3 has a volume of 0.09748 in $^3$ as compared to the commercial hard insert used in Kennametal's C-3MLR style of tool which has a volume of 0.1151 in $^3$. The specific embodiment of FIGS. 4–6 has a volume of 0.10476 in $^3$. Both embodiments have less overall carbide than a standard commercial hard insert.

The braze joint of these specific embodiments is configured so as to better withstand the stresses exerted thereon during operation. The fact that the angle of taper of the frusto-conical surface of the boss is 45° helps to more evenly distribute stress on the braze joint. The flat face of the forward end of the steel body is one of the opposing surface over a part of the braze joint. The use of the face of the forward end of the rotatable cutting tool provides for a braze joint that is better able to withstand operational stresses.

In the first specific embodiment, the integral cylindrical portion 42 is of a diameter H which, although less than the diameter of the forward end 14 of the steel body 12, extends over the braze joint 66. Thus, the portion of the cemented carbide insert 32 which extends over the braze joint helps protect the braze joint from steel erosion during operation. In the second embodiment the integral cylindrical portion has a diameter S equal to the diameter of the forward end 84 so that the cemented carbide insert 102 helps protect the braze joint 136 from steel erosion during operation.

The bumps act to provide for a braze joint of a more uniform thickness which provides a braze joint with a consistent predictable strength Thus, the configuration of the braze joint as well as the consistency of the braze joint results in the improved performance of the rotatable cutting tool. Depending upon the application the height of one set of bumps may be different from the height of the other set.

Another factor which influences the integrity of the braze joint is the precision with which the cemented carbide insert is centered within the socket. In a production line environment, it is important that the insert is easily and precisely centered within the socket. The present embodiments provides two structural features that assist with the easy and precise centering operation. More specifically, the complementary frusto-conical surfaces of the boss and the socket assist with the precise positioning of the cemented carbide insert in the socket. The bumps on the side of frusto-conical surface of the boss cooperate with the frusto-conical surface of the socket to assist with the precise positioning of the insert in the socket.

The socket in the tool body can be cold formed to its final dimension due to the shallowness thereof. The shallowness is a result of the new design which eliminates the need to machine any portion of the socket. Hence, the manufacturing cost associated with the steel body of the specific embodiments is meaningfully reduced over previous rotatable cutting tools which required the socket to be machined.

In a typical road planing operation the cemented carbide insert impacts the road surface upon the rotation of the drum. Over the course of the road planing operation the cemented carbide insert experiences wear whereby the conical tip section is worn off and the mediate section is worn off down to the mediate concave portion. The remaining part of the insert is generally conically shaped and symmetric about its longitudinal axis whereby the included angle of taper is between about 110° and about 130°. It is at this point that the operator should change the cutting tool. In order to assist the operator in changing tools, the mediate frusto-conical portion is configured to present an included angle of taper of 120°. Thus, when the operator sees that the mediate frusto-conical portion of the cemented carbide insert is generally co-planer with the adjacent portion of the insert, he knows that the tool should be replaced.

As is well known to those of ordinary skill in the art, at the junctures of the various surfaces described on the carbide tip, chamfers, fillets and/or pressing flats may be provided, where appropriate, to assist in manufacturing and/or provide added strength to the structure.

Other specific embodiments of the invention will be apparent to those skilled in the art from a consideration of this specification or practice of the invention disclosed herein. It is intended that the specification and specific embodiments be considered as exemplary only, with the true scope and spirit of the invention being indicated by the following claims.

What is claimed is:

1. A rotatable cutting tool comprising:

a tool body having opposite forward and rearward ends, said forward end having a socket contained therein, said socket having a generally flat bottom surface and a generally frusto-conically shaped annular side surface whereby the socket defines a volume of a generally frusto-conical shape;

a hard insert affixed to said tool body at the forward end thereof;

said hard insert including:

an integral cylindrical flange portion, said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

first means, projecting from the bottom surface of the flange portion, for providing a uniform spacing of the bottom surface from the surface of the one end of the tool body; and second means, projecting from the frusto-conical surface of the boss, for providing a uniform spacing of the frusto-conical portion of the boss from the frusto-conical surface of the socket.

2. The rotatable cutting tool of claim 1 wherein said hard insert further includes an integral tip portion;

said integral cylindrical flange portion joined to the tip portion by an integral mediate portion which is contiguous at the axially forward end thereof with the tip portion and at the axially rearward end thereof with the flange portion.

3. The rotatable cutting tool of claim 1 wherein the forward end of the steel body is of a generally circular configuration and has a first diameter.

4. The rotatable cutting tool of claim 3 wherein the integral cylindrical flange portion is of a second diameter wherein said first and second diameters are substantially equal.

5. The rotatable cutting tool of claim 3 wherein the integral cylindrical flange portion is of a second diameter wherein said first diameter is greater than said second diameter.

6. The rotatable cutting tool of claim 1 wherein said frusto-conically shaped annular side surface of the socket is disposed at an included angle of about 84° to about 96° with respect to the longitudinal axis of the rotatable cutting tool.

7. The rotatable cutting tool of claim 1 wherein the hard insert is affixed by brazing to the tool body.

8. The rotatable cutting tool of claim 1 wherein the frusto-conically shaped side surface of the boss is disposed at an angle of taper of about 45°.

9. The rotatable cutting tool of claim 1 wherein said first means comprises a plurality of bumps.

10. The rotatable cutting tool of claim 1 wherein said second means comprises a plurality of bumps.

11. A rotatable cutting tool comprising:

a tool body having opposite forward and rearward ends, said forward end having a socket contained therein, said socket having a generally flat bottom surface and a generally frusto-conically shaped annular side surface whereby the socket defines a volume of a generally frusto-conical shape;

a hard insert affixed to said tool body at the forward end thereof;

said hard insert comprising:

an integral tip portion;

an integral mediate cylindrical portion contiguous with and positioned axially rearwardly of the tip portion;

an integral mediate concave portion contiguous with and positioned axially rearwardly of the mediate cylindrical portion;

an integral mediate frusto-conical portion contiguous with and positioned axially rearwardly of the mediate concave portion, said mediate frusto-conical portion being disposed at an angle approximately equal to the wear angle of the hard insert;

an integral cylindrical flange portion contiguous with and positioned axially rearwardly of the mediate frusto-conical portion, and said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

means, projecting from the bottom surface of the flange portion and the frusto-conical surface of the boss, for providing a uniform spacing of the bottom surface and the boss from the surface of the one end of the tool body and the socket.

12. The rotatable cutting tool of claim 11 wherein the spacing means includes:

a plurality of first bumps projecting from the bottom surface of the flange portion; and a plurality of second bumps projecting from the frusto-conical surface of the boss.

13. The rotatable cutting tool of claim 11 wherein the mediate frusto-conical portion is disposed at an included angle equal to between about 110° and about 130°.

14. The rotatable cutting tool of claim 11 wherein the integral conical tip portion has an included angle between about 84° and about 96°.

15. A hard insert for use in a rotatable cutting tool wherein the insert is affixed in a socket contained in the forward end of the tool, the hard insert comprising:

an integral tip portion;

an integral cylindrical flange portion joined to the tip portion by an integral mediate portion which is contiguous at the axially forward end thereof with the tip portion and at the axially rearward end thereof with the flange portion, and said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

first means, projecting from the bottom surface of the flange portion, for providing a uniform spacing of the bottom surface from the surface of the forward end of the tool body; and second means, projecting from the frusto-conical surface of the boss, for providing a uniform spacing of the frusto-conical portion of the boss from the frusto-conical surface of the socket.

16. A hard insert for use in a rotatable cutting tool wherein the insert is affixed in a socket contained in the forward end of the tool, the hard insert comprising:

an integral tip portion;

an integral cylindrical flange portion joined to the tip portion by an integral mediate portion which is contiguous at the axially forward end thereof with the tip portion and at the axially rearward end thereof with the flange portion, and said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

first means, projecting from the bottom surface of the flange portion, for providing a uniform spacing of the bottom surface from the surface of the forward end of the tool body;

second means, projecting from the frusto-conical surface of the boss, for providing a uniform spacing of the frusto-conical portion of the boss from the frusto-conical surface of the socket said integral mediate portion comprises:

an integral mediate cylindrical portion contiguous with and positioned axially rearwardly of the tip portion;

an integral mediate concave portion contiguous with and positioned axially rearwardly of the mediate cylindrical portion; and an integral mediate frusto-conical portion contiguous with and positioned axially rearwardly of the mediate concave portion, said mediate frusto-conical portion being disposed at an angle approximately equal to the wear angle of the hard insert.

17. A hard insert for use in a rotatable cutting tool wherein the insert is affixed in a socket contained in the forward end of the tool, the hard insert comprising:

an integral tip portion having a maximum first diameter;

an integral cylindrical flange portion joined to the tip portion by an integral mediate portion which is contiguous at the axially forward end thereof with the tip portion and at the axially rearward end thereof with the flange portion, the axially forward end being of a second diameter, and said flange portion having a bottom surface facing axially rearwardly;

the maximum first diameter being less than the second diameter;

an integral boss projecting from the bottom surface of the flange portion, said boss having a generally flat bottom surface and a generally frusto-conically shaped annular side surface wherein the shape of the socket;

a first means, projecting from the bottom surface of the flange portion, for providing a uniform spacing of the bottom surface from the surface of the forward end of the tool body; and a second means, projecting from the frusto-conical surface of the boss, for providing a uniform spacing of the frusto-conical portion of the boss from the frusto-conical surface of the socket.

18. The hard insert of claim 17 wherein said integral mediate portion is comprised of a plurality of integral contiguous concave sections each having a different radius of curvature.

19. The hard insert of claim 18 wherein the radius of curvature decreased for each section closer to the cylindrical flange portion.

20. The hard insert of claim 17 wherein said integral mediate portion is comprised of a trio of integral contiguous concave sections.

21. A rotatable cutting tool comprising:

a tool body having opposite forward and rearward ends, said forward end having a socket contained therein, said socket having a generally flat bottom surface and a generally frusto-conically shaped annular side surface whereby the socket defines a volume of a generally frusto-conical shape;

a hard insert affixed to said tool body at the forward end thereof;

said hard insert comprising:

an integral tip portion having a maximum first diameter;

an integral concave portion contiguous with and positioned axially rearwardly of the tip portion, said concave portion having a minimum second diameter;

said maximum first diameter being less than said minimum second diameter;

an integral cylindrical flange portion contiguous with and positioned axially rearwardly of the mediate concave portion, and said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

means, projecting from the bottom surface of the flange portion and the frusto-conical surface of the boss, for providing a uniform spacing of the bottom surface and the boss from the surface of the one end of the tool body and the socket.

22. The rotatable cutting tool of claim 21 wherein the spacing means includes:

a plurality of first bumps projecting from the bottom surface of the flange portion; and a plurality of second bumps projecting from the frusto-conical surface of the boss.

23. A rotatable cutting tool comprising:

a tool body having opposite forward and rearward ends, said forward end having a socket contained therein, said socket having a generally flat bottom surface and a generally frusto-conically shaped annular side surface whereby the socket defines a volume of a generally frusto-conical shape;

a hard insert affixed to said tool body at the forward end thereof;

said hard insert including:

an integral cylindrical flange portion, said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

first means, projecting from the bottom surface of the flange portion, for providing a uniform spacing of the bottom surface from the surface of the one end of the tool body;

second means, projecting from the frusto-conical surface of the boss, for providing a uniform spacing of the frusto-conical portion of the boss from the frusto-conical surface of the socket;

an integral tip portion; said integral cylindrical flange portion joined to the tip portion by an integral mediate portion which is contiguous at the axially forward end thereof with the tip portion and at the axially rearward end thereof with the flange portion;

said mediate portion comprises:

an integral mediate cylindrical portion contiguous with and positioned axially rearwardly of the tip portion;

an integral mediate concave portion contiguous with and positioned axially rearwardly of the mediate portion; and an integral mediate frusto-conical portion contiguous with the positioned axially rearwardly of the mediate concave portion, said mediate frusto-conical portion being disposed at an angle approximately equal to the wear angle of the hard insert.

24. The rotatable cutting tool of claim 23 wherein said cylindrical flange portion is contiguous with and positioned axially rearwardly of said mediate frusto-conical portion.

25. The rotatable cutting tool of claim 23 wherein said mediate frusto-conical portion is disposed at an angle with respect to the longitudinal axis of the tool equal to approximately 60°.

26. A rotatable cutting tool comprising:

a tool body having opposite forward and rearward ends, said forward end having a socket contained therein, said socket having a generally flat bottom surface and a generally frusto-conically shaped annular side surface whereby the socket defines a volume of a generally frusto-conical shape;

a hard insert affixed to said tool body at the forward end thereof;

said hard insert including:

an integral cylindrical flange portion, said flange portion having a bottom surface facing axially rearwardly;

an integral boss projecting from the bottom surface of the flange portion, said boss having a generally flat bottom surface and a generally frusto-conically shaped annular side surface wherein the shape of the boss generally corresponds to the shape of the socket;

first means, projecting from the bottom surface of the flange portion, for providing a uniform spacing of the bottom surface from the surface of the one end of the tool body;

second means, projecting from the frusto-conical surface of the boss, for providing a uniform spacing of the frusto-conical portion of the boss from the frusto-conical surface of the socket; and said first means comprises a first trio of equi-spaced bumps, said second means comprises a second trio of equi-spaced bumps, and said first and second trios of bumps are disposed at 60° from each other.

27. The rotatable cutting tool of claim 26 wherein the first trio of bumps is of a first height and the second trio of bumps is of a second height.

28. The rotatable cutting tool of claim 27 wherein the first height is greater than the second height.

29. The rotatable cutting tool of claim 27 wherein the second height is greater than the first height.

* * * * *

UNITED STATES PATENT AND TRADEMARK OFFICE

CERTIFICATE OF CORRECTION

PATENT NO. : 4,981,328

DATED : January 1, 1991

INVENTOR(S) : Stiffler et al.

It is certified that error appears in the above-identified patent and that said Letters Patent is hereby corrected as shown below:

On the title page, item [54], lines 1 and 2, in col. 1, lines 2 and 3, the title should read as follows:
--ROTATABLE CUTTING TOOL HAVING A CARBIDE INSERT WITH BUMPS--.

At Column 1, line 2, the word "CUTTING" is between the words "ROTATABLE" and "TOOL"

At Column 7, line 3, the number "30" should follow the word "surface".

At Column 15, line 29, after "the" add "boss generally corresponds to the shape of".

Signed and Sealed this

Seventeenth Day of November, 1992

*Attest:*

DOUGLAS B. COMER

*Attesting Officer*

*Acting Commissioner of Patents and Trademarks*